US011795632B2

(12) United States Patent
Saari et al.

(10) Patent No.: US 11,795,632 B2
(45) Date of Patent: Oct. 24, 2023

(54) SYSTEMS AND METHODS FOR SURFACE MILLING

(71) Applicant: Caterpillar Paving Products Inc., Brooklyn Park, MN (US)

(72) Inventors: Jacob M. Saari, Nowthen, MN (US); Nicholas Argenziano, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 105 days.

(21) Appl. No.: 17/514,817

(22) Filed: Oct. 29, 2021

(65) Prior Publication Data

US 2023/0132726 A1 May 4, 2023

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 8,794,869 | B2 * | 8/2014 | Schlenker | E01C 23/088 299/1.5 |
| 10,094,078 | B2 | 10/2018 | Husar | |
| 10,704,213 | B2 * | 7/2020 | Gerhardy | E01C 23/088 |
| 2013/0341996 | A1 * | 12/2013 | Franzmann | E01C 23/088 299/1.5 |
| 2019/0203430 | A1 | 7/2019 | Wachsmann et al. | |
| 2020/0156079 | A1 | 5/2020 | Argenziano | |

FOREIGN PATENT DOCUMENTS

| | | | |
|---|---|---|---|
| CN | 102168401 | B | 10/2012 |
| CN | 203144877 | U | 8/2013 |
| CN | 212000545 | U | 11/2020 |

* cited by examiner

*Primary Examiner* — Janine M Kreck
(74) *Attorney, Agent, or Firm* — Bookoff McAndrews, PLLC

(57) ABSTRACT

In one aspect, a method for monitoring a milling machine having a milling rotor and a rotor chamber surrounding the milling rotor includes propelling the milling machine in a direction of travel, positioning a door of the rotor chamber at a first position with an actuator, and receiving a signal indicative of a condition of the actuator for positioning the door of the rotor chamber. The method further includes determining that the door has encountered material based on the signal and opening the door of the chamber in response to determining that the door has encountered material.

19 Claims, 4 Drawing Sheets

SYSTEMS AND METHODS FOR SURFACE MILLING

TECHNICAL FIELD

The present disclosure relates generally to methods and systems for milling machines and, more particularly, to systems and methods for a milling machine having a rotor chamber.

BACKGROUND

Milling machines are useful in applications where it is desirable to remove material from a ground surface. Milling machines, which can include rotary mixers, cold planers, and other machines, are used for reclamation of asphalt or soil-based roadways for road rehabilitation, soil stabilization, surface mining, bio-remediation, agriculture, and other applications. Rotary mixers, cold planers, and similar machines include rotors with a drum and tool bits designed for removing and pulverizing material. The tool bits and rotor can be positioned within a partially-enclosed compartment with an open bottom surface and hydraulically-operated front and rear doors to facilitate mixing and homogenization of the material removed with the tool bits.

During operation of a milling machine that includes a rotor chamber, doors of the chamber are placed in a desired position, typically by an operator's manual interaction with an input device. In some machines, the rotor chamber doors are fully operator-controlled, such that the operator of the machine can place the doors in a specific desired position, such as fully closed, fully open, 50% open, etc. If the operator fails to select a condition-appropriate position for a front door, a rear door, or both, the doors can encounter material, such as asphalt, soil, rock, debris, etc., and even plow this material while the machine travels. Even when the doors are opened to an adequate degree, the door may encounter mounds of debris. Striking this material with a rotor chamber door can increase wear on the door, and on the hydraulic cylinders for raising and lowering the doors. In some circumstances, a door can plow material or strike a debris pile with sufficient force so as to damage the door, a component of the hydraulic system for the door, or both. This increased wear or damage can require increased maintenance, repair, and even replacement of the doors and/or mechanisms for opening and closing the doors.

A pavement planer including a tailgate lifting device with a pressure sensor is described in CN 102168401B ("the '401 publication") to Yongbiao Hu et al. The pavement planer described in the '401 publication includes a control system that monitors pressure of a tailgate. When the pressure of the tailgate is above or below certain setpoints, the control system can adjust the pressure. While the pavement planer described in the '401 publication may be useful in some circumstances, it may be unable to identify and remedy situations where a door encounters material before the material reaches the rotor, and may be unable to raise a door encountering this material in an automated manner.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a method for monitoring a milling machine having a milling rotor and a rotor chamber surrounding the milling rotor may include propelling the milling machine in a direction of travel, positioning a door of the rotor chamber at a first position with an actuator, and receiving a signal indicative of a condition of the actuator for positioning the door of the rotor chamber. The method may further include determining that the door has encountered material based on the signal and opening the door of the chamber in response to determining that the door has encountered material.

In another aspect, a method for monitoring a milling machine having a milling rotor, a rotor chamber surrounding the milling rotor, a first door of the rotor chamber, and a second door of the rotor chamber may include determining a direction of travel of the milling machine and determining that the first door or the second door is a forward door that faces the direction of travel. The method may further include determining that the forward door has encountered material based on a signal generated with a sensor associated with the forward door and automatically opening the forward door in response to determining that the door has encountered material.

In yet another aspect, a milling system may include a frame, a rotor chamber connected to the frame, the rotor chamber having a first door and a second door opposite the first door, a first hydraulic cylinder configured to open and close the first door, and a sensor configured to output a signal that indicates when the first door has encountered material. The system may further include a controller configured to receive the signal from the sensor, determine that the signal indicates that the first door has encountered material, and cause the first door to open in response to determining that the first door has encountered material.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. As used herein, "encountering material," or "encountered material," refers to one or more components that strike soil, rock, or other types of debris, or other material, this material being present outside of a chamber that encloses the rotor, with force sufficient to cause a measureable change in the position of the component (e.g., a door), a measureable change in a position of an actuator connected to the component (e.g., a hydraulic cylinder for opening and closing a door), and/or a measureable change in a pressure of hydraulic fluid supplied to the actuator.

Figure 1A:
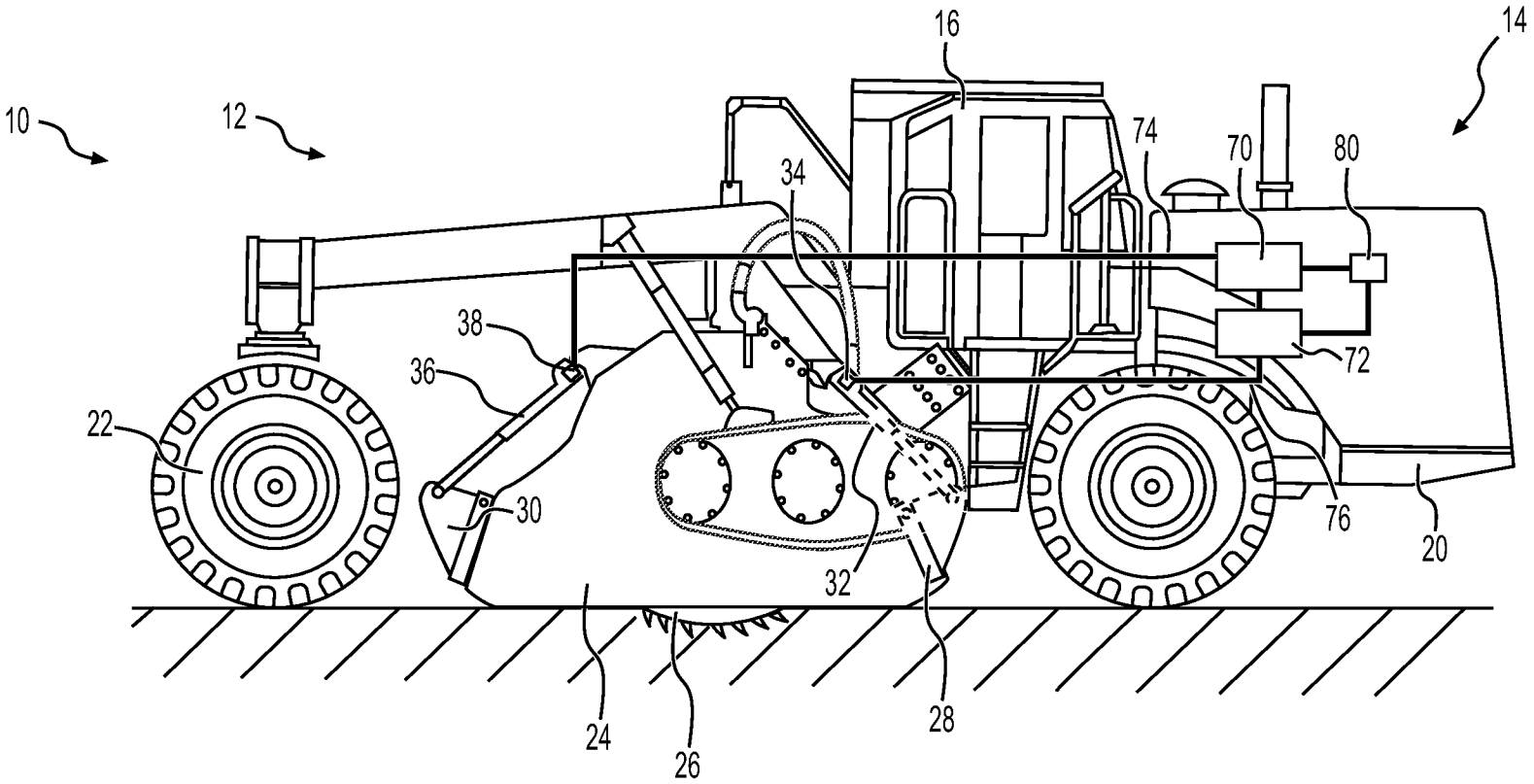
FIG. 1A is a schematic diagram of a milling machine with doors in a closed position, according to aspects of the disclosure.
Figure 1B:
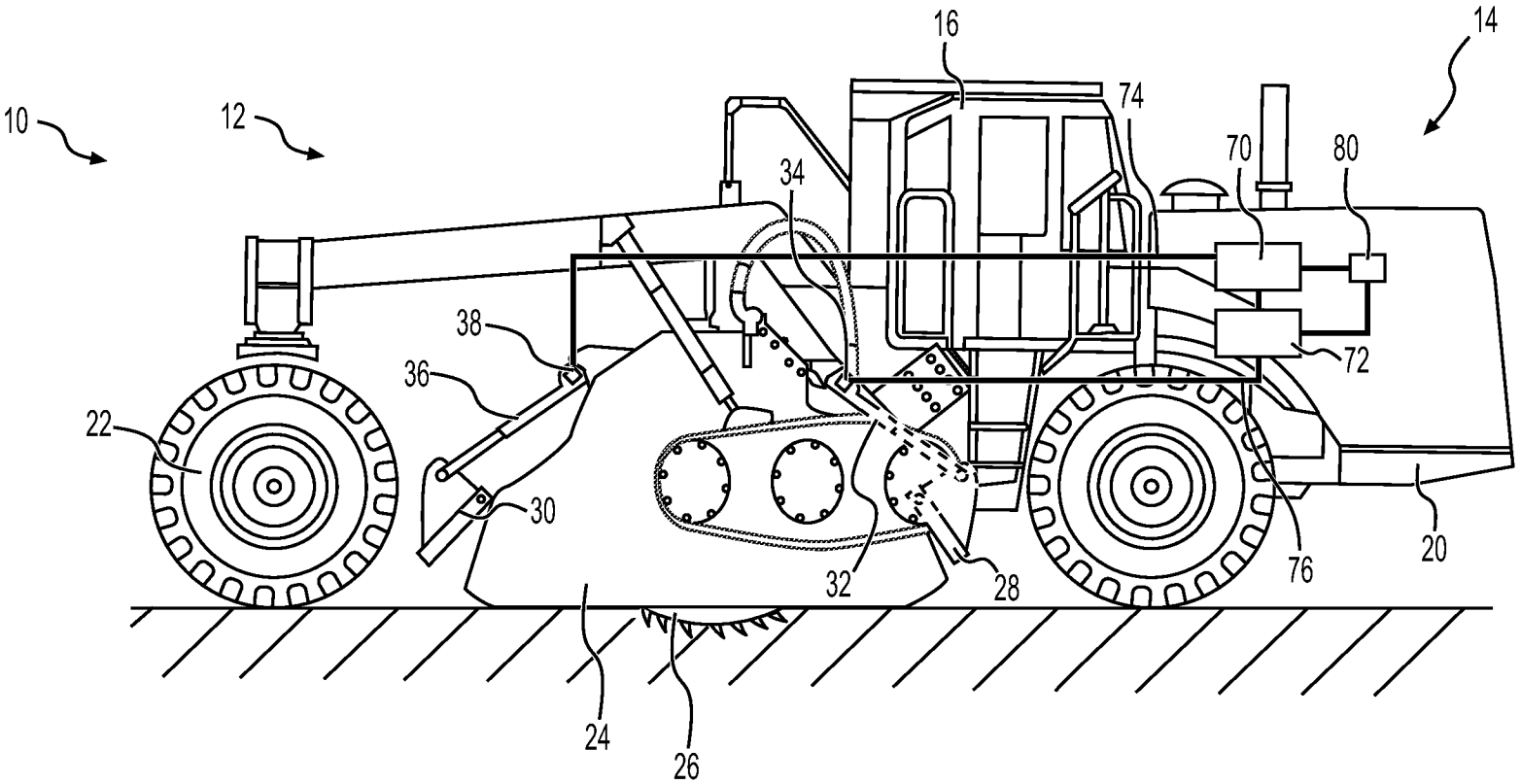
FIG. 1B is a schematic diagram of the milling machine of FIG. 1A with doors in an open position, according to aspects of the disclosure.

FIGS. 1A and 1B illustrate an exemplary machine system 10 that includes a machine 12 and an automatic door control system 14. Machine 12 of system 10 may be a milling machine, such as a rotary mixer or a cold planer configured to remove surface materials. However, machine 12 may include one or more other types of machines. Machine 12 may include a cabin 16, frame 20, ground-engaging traction devices 22 such as wheels or tracks (wheels being shown in FIGS. 1A and 1B), and a rotor chamber 24 that surrounds a milling rotor 26. Frame 20 may support rotor chamber 24 such that a front door 28 faces a front end of machine 12 (e.g., a direction an operator faces when present in cabin 16) and a rear door 30 faces a rear end of machine 12.

As shown in FIGS. 1A and 1B, machine 12 may be a rotary mixer in which milling rotor 26, including a drum and a plurality of tool bits, is controllably (selectively and/or automatically) lowered to remove material from a ground surface. Rotor 26 may be rotatably mounted within rotor chamber 24 such that cutting bits secured to an outer periphery of rotor 26 engage the ground and/or pavement to remove and pulverize material when machine 12 is operated, as described below. Doors 28 and 30 may be movable between closed positions shown in FIG. 1A and open positions shown in FIG. 1B. One or more control devices for selective operation of doors 28 and 30 may be present within cabin 16. These controls may include a first control switch or button that opens door 28 (e.g., when pressed), a second control switch or button that closes door 28, as well as third and fourth control switches that open and close door 30. If desired, one or more control devices within cabin 16 may enable automatic monitoring of one or both doors 28 and 30 via automatic door control system 14, such that the operator-set position of doors 28 or 30 are overridden when the door encounters material, as described below. Alternatively, automatic monitoring of doors 28 and/or 30 may be enabled with door control system 14 without the need to affirmatively enable automatic monitoring with a control device.

Automatic door control system 14 of machine system 10 may include hydraulic devices that together control the positions of doors 28 and 30. These hydraulic devices may include a first actuator (front hydraulic cylinder 32), a second actuator (rear hydraulic cylinder 36), hydraulic valves 70 and 72, one or more respective fluid lines 74 and 76 in communication with cylinders 32 and 36 and valves 70 and 72, and other suitable hydraulic components, such as pumps, further valves, etc. Automatic door control system 14 may also include an electronic control module (ECM) 80 and one or more door sensors, two shown in FIGS. 1A and 1B, door sensors 34 and 38. ECM 80 may be in communication with door sensors 34 and 38 to detect a condition of hydraulic cylinders 32 and 36 connected to doors 28 and 30 based on the signals generated by these sensors 34 and 38, as described below.

In an exemplary configuration, door sensors 34 and 38 may include one or more pressure sensors configured to sense a pressure of hydraulic fluid associated with hydraulic cylinders 32 and 36. Additionally or alternatively, door sensors 34 and 38 may include one or more position sensors (e.g., hall-effect sensors) configured to detect a position of a movable member (e.g., a rod) of hydraulic cylinders 32 and 36, respectively. While FIGS. 1A and 1B illustrate a single hydraulic fluid line 74 and 76, respectively, for hydraulic cylinders 32 and 36, as understood, hydraulic fluid lines 74 and 76 may each represent a plurality of hydraulic fluid lines, as described below and shown in FIG. 2. Moreover, while a single valve 70, 72, is shown for each hydraulic fluid line 74, 76 and each cylinder 32, 36, valves 70 and 72 may be part of a hydraulic system including one or more additional control valves, hydraulic pumps, motors, hydraulic fluid reservoirs, etc. Similarly, hydraulic cylinders 32 and 36 may represent a plurality of hydraulic cylinders, for example to distribute the load for opening, closing, and supporting a door across multiple actuators.

ECM 80 may be enabled, via programming, to monitor and control states of doors 28 and 30 based on one or more conditions of machine 12 and information received from a pressure sensor and/or a position sensor associated with an actuator for one of doors 28 and 30. In particular, ECM 80 may be configured to control a position of doors 28 and 30 based on a calculated, requested, or detected travel direction of machine 12 and a detected condition of the door 28, door 30, or both detected with sensors 34 and 38. In particular, ECM 80 may be configured to automatically open door 28, door 30, or both, in response to determining that the door facing a direction of travel of machine 12 is currently encountering material or encountered material recently. ECM 80 may be enabled to continuously monitor doors 28 and 30 in this manner, or may instead monitor doors 28 and 30 in response to a request initiated by an operator in cabin 16. Such a request may be initiated by interacting with a switch, button, touchscreen, etc., to enable automatic monitoring in which ECM 80 monitors one or both of doors 28 and 30.

Figure 2:
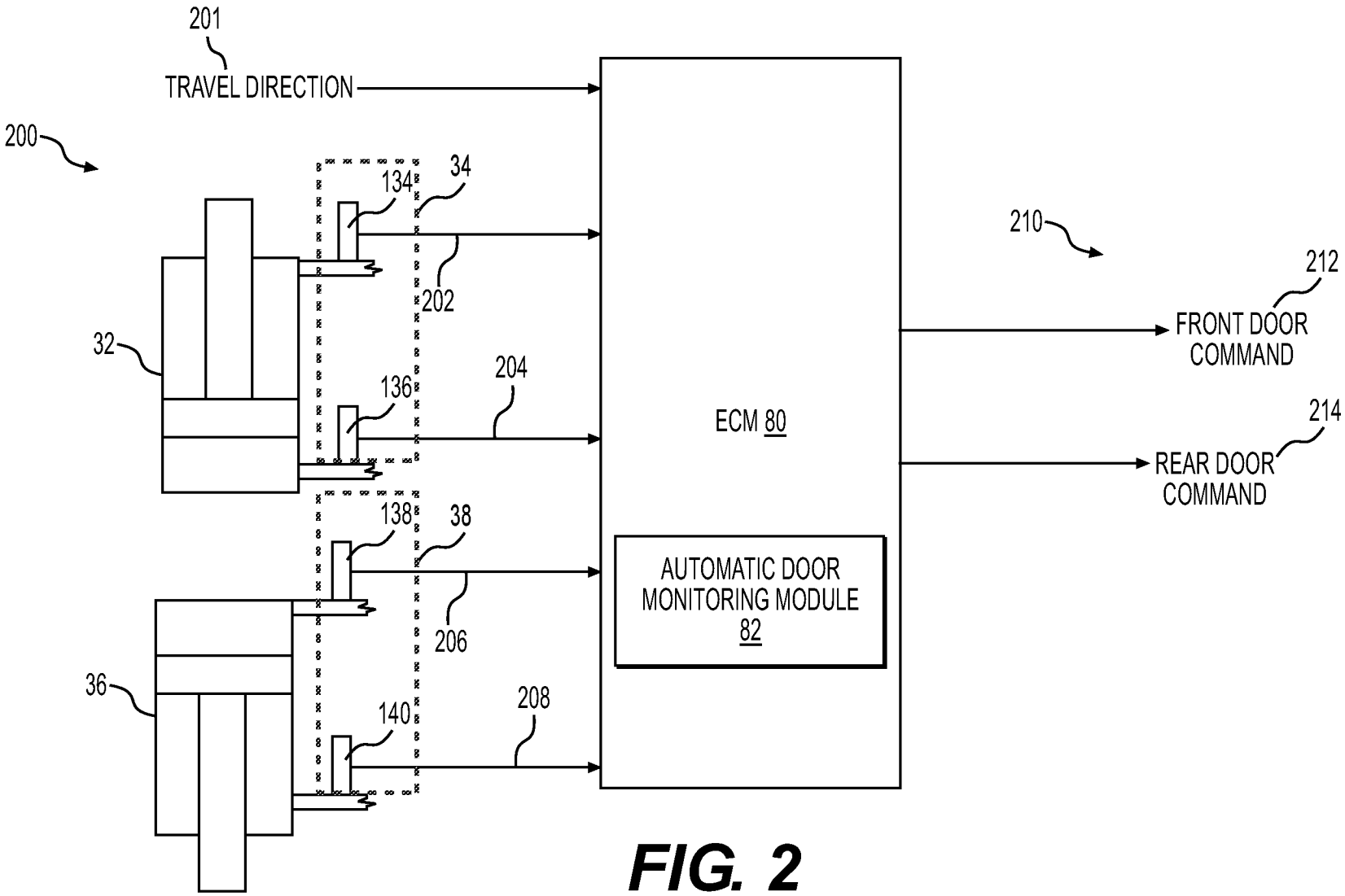
FIG. 2 is a block diagram showing a rotor chamber door control system, according to aspects of the disclosure.

In order to achieve these functions, ECM 80 may be programmed to implement an automatic door monitoring module 82 (FIG. 2). ECM 80 may employ functions associated with automatic door monitoring module 82 to identify which door 28, 30, faces a direction of travel and to automatically open this door after determining that the door has impacted material. If desired, ECM 80 may be in communication with one or more additional electronic control modules, including control modules for controlling a power source such as an internal combustion engine, a control module for a transmission system, additional hydraulic components, etc. Additionally or alternatively, ECM 80 may itself be programmed to control one or more aspects of system 10 in addition to the position of doors 28 and 30.

ECM 80 may embody a single microprocessor or multiple microprocessors that receive inputs and generate outputs. ECM 80 may include a memory, a secondary storage device, a processor, such as a central processing unit or any other means for accomplishing a task consistent with the present disclosure. The memory or secondary storage device associated with ECM 80 may store data and software to allow ECM 80 to perform its functions including the functions described with respect to FIG. 2 and method 300 described below. Numerous commercially available microprocessors can be configured to perform the functions of ECM 80. Various other known circuits may be associated with ECM 80, including signal-conditioning circuitry, communication circuitry, and other appropriate circuitry.

FIG. 2 is a block diagram of an exemplary configuration of ECM 80 that may enable monitoring functions for doors 28 and 30 of rotor chamber 24. In some aspects, door monitoring functions performed with ECM 80 may identify a door 28 or 30 that faces a direction of travel of machine 12 and open the identified door to avoid or mitigate damage due to loose debris or other material impacting the door due to the travel of machine 12. ECM 80 may receive a plurality of inputs 200, such as a travel direction 201, a rod end signal 202 and/or head end signal 204 associated with hydraulic cylinder 32, and a head end signal 206 and rod end signal 208 associated with hydraulic cylinder 36. Based on inputs 200, ECM 80 may generate outputs 210 including commands for actuators of doors 28 and 30, such as commands for hydraulic valves 70 and 72.

When automatic door monitoring module 82 of ECM 80 is active or enabled, ECM 80 may identify when a door has been struck with debris, based on inputs 200. In response to this determination, ECM 80 may generate one or more outputs 210 that cause the corresponding door to open by a greater degree. With reference to the exemplary configuration shown in FIG. 2, ECM 80 may receive travel direction 201. Travel direction 201 may correspond to a direction of travel (e.g., forward or reverse) based on a request for propulsion from an operator. For example, an operator may select a travel direction such as forward or reverse with a lever or switch, the position of which is monitored with a position sensor that outputs travel direction 201 as a signal. Additionally or alternatively, travel direction 201 may be determined based on one or more speed sensors (e.g., a sensor associated with one or more traction devices 22), one or more accelerometers secured to frame 20 of machine 12, etc.

ECM 80 may receive one or more inputs 200 in additional to travel direction 201 to allow automatic door monitoring module 82 to determine when a door that faces the direction indicated by travel direction signal 201 has encountered material, such as a pile of debris. As used herein, the "forward door" is the door that faces the direction indicated by direction of travel 201. When the direction of travel 201 is reverse, for example, the "forward door" is door 30, which is farther from cabin 16 as compared to door 28. In the example illustrated in FIG. 2, door sensor 34 (FIGS. 1A and 1B) corresponds to a plurality of sensors, including a rod end pressure sensor 134 and a head end pressure sensor 136. Similarly, door sensor 38 (FIGS. 1A and 1B) may represent a plurality of sensors, such as rod end pressure sensor 140 and head end pressure sensor 138. However, in at least some configurations, door sensors 34 and 38 may represent a single sensor (e.g., rod end pressure sensor 134 and rod end pressure sensor 140, respectively).

Rod end pressure sensor 134 may be configured to generate a pressure signal 202 that indicates or otherwise corresponds to the pressure of hydraulic fluid within a hydraulic fluid line connected to the rod end of hydraulic cylinder 32. A rod end of a hydraulic cylinder may include a first chamber through which a rod extends, the first chamber having a variable volume that surrounds the rod. Head end pressure sensor 136 may be configured to generate a pressure signal 204 that is indicative of a pressure of fluid in a head end of hydraulic cylinder 32. A head end of a hydraulic cylinder 32 may include a second chamber isolated from the first chamber by a piston, the second chamber having a variable volume whose size is inversely proportional to the size of the first chamber. Rod end pressure sensor 140 and head end pressure sensor 138 may operate in a manner analogous to pressure sensors 134 and 136, respectively, and may generate a pressure signal 206 indicative of pressure of fluid in a head end of hydraulic cylinder 36 and a pressure signal 208 indicative of pressure in a rod end of hydraulic cylinder 36.

Pressure sensors 134 and 136 may be associated with a door that has a higher likelihood of being the "front" door, door 28, (e.g., the door that faces the travel direction when machine 12 moves in a direction indicated as "forward" by an in-cabin selector, a position faced by an operator when seated in cabin 16, etc.). Pressure sensors 138 and 140 may be associated with a door that has a higher likelihood of being the "rear" door, door 30, (e.g., the door that faces the travel direction when machine 12 moves in a direction indicated as "reverse" by an in-cabin selector).

While sensors 134, 136, 138, and 140 have been described as being pressure sensors, inputs 200 may include one or more position sensors that are configured to detect a movement of the rod of a respective hydraulic cylinder 32 or 36, as described above. Instead of or in addition to sensors 134, 136, 138, and 140, a load cell may be used as sensor 34 and/or 38, the load cell being able to detect an amount of force applied to cylinders 32 and 36.

Automatic door monitoring module 82 may be configured to evaluate at least one of signals 202, 204, 206, and 208 to determine when a front-facing door 28 or 30 is encountering material, as described in more detail below. Automatic door monitoring module 82 may be configured to take action, by generating outputs 210, to open the door that has encountered material. Outputs 210 may be generated by module 82, for example, without operator intervention. For example, automatic door monitoring module 82 may be configured to generate a front door command signal 212 or a rear door command 214 to actuate the appropriate cylinder 32 or 36 based on travel direction 201 and information received by one or more of sensors 134, 136, 138, and 140, the information from the sensor being indicative that the door is encountering material from outside of rotor chamber 24. Front door command 212 or rear door command 214, when generated in this manner, may override the operator's setting. For example, if an operator has set front door 28 to a partially-open position (e.g., 50% open, or halfway between a fully-closed position and a fully-open position), front door command 212 may be generated to open door 28 by a greater degree in response to determining that door 28 has encountered material.

Automatic door monitoring module 82 may be selectively active, if desired. For example, automatic door monitoring module 82 may be perform monitoring and door control functions only when an automatic door monitoring mode is enabled by an operator (e.g., by manipulating a control within cabin 16). Alternatively, automatic door monitoring module 82 may be active whenever machine 12 is running, whenever rotor chamber 24 and/or rotor 26 are lowered to a working condition in which surface material can be removed, etc.

Automatic door monitoring module 82 may be configured to output a front door command 212 when the front door 28 of machine 12 is determined to face travel direction 201 and encounters material, overriding the position for door 28 set by an operator within cabin 16. In a corresponding manner, when monitoring module 82 determines that rear door 30 faces travel direction 201 and encounters debris such as loose material, automatic door monitoring module 82 may output a command to rear door command 214 that opens door 30 by a greater degree than that set by an operator of machine 12.

In at least some configurations, automatic door monitoring module 82 may be configured to perform automatic control on a door that faces away from the determined travel direction. For example, automatic door monitoring module 82 may be configured to cause the door facing away from travel direction 201 (e.g., front door 28 when direction 201 is reverse, rear door 30 when direction 201 is forward) to apply an approximately constant downpressure, enabling automatic control of this door independently of the control of the door that faces the direction of travel. In some aspects, the pressure may be determined based on head end pressure sensors 136 and 138, and may enable closed-loop control over the downpressure of the door 28 or 30 that faces away from travel direction 201. This pressure may be set, for example, by an operator to assist with gradation of material that exits chamber 24. Thus, automatic control of doors 28 and 30, and generated commands 212 and 214, may be performed based on travel direction 201, preventing material from striking the door facing direction of travel 201, while allowing closed-loop control over the door that faces away from direction of travel 201.

INDUSTRIAL APPLICABILITY

Machine system 10 may include any suitable machine 12 having a door that faces a direction of travel during at least some operating conditions of machine 12. Machine 12 may therefore be a mobile machine, such as a milling machine, in which front and rear doors 28 and 30 are configured to provide control over a quantity of material within rotor chamber 24.

Figure 3:
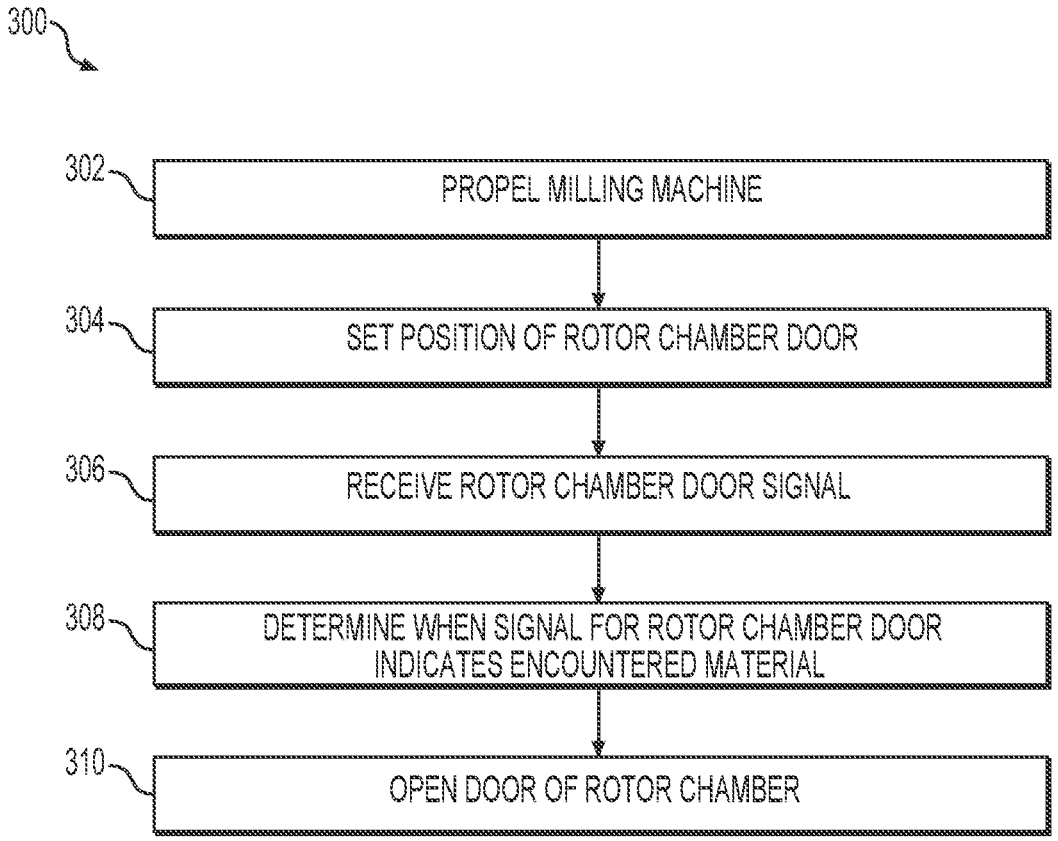
FIG. 3 is a flowchart depicting an exemplary method for automatic control of a rotor chamber door, according to aspects of the disclosure.

FIG. 3 is a flowchart illustrating an exemplary method 300 for monitoring a milling machine such as machine 12, according to aspects of the present disclosure. Method 300 may be performed while operating machine 12 to remove material from a paved surface, loose soil, hard-packed material, etc., to facilitate road production or rehabilitation, soil stabilization, mining, bio-remediation, agriculture, etc. During method 300, one or more power-generating devices, such as an internal combustion engine, and power transferring devices, such as a transmission, may operate to generate power to propel machine 12 in a direction of travel (e.g., to the right in FIGS. 1A and 1B) and to provide energy for operating the hydraulic system of machine 12. Method 300 may be performed continuously during the operation of machine 12, or in response to a particular condition. This condition may include when an automatic operation mode is enabled (e.g., a mode for supervising a door that faces the direction of travel of machine 12). Additionally or alternatively, the condition for performing method 300 may include determining with ECM 80 that rotor chamber 24 and/or rotor 26 are in a suitable position for performing work on a ground surface (e.g., when rotor chamber 24 and rotor 26 are lowered to an appropriate height).

A step 302 of method 300 may include propelling machine 12 in a direction of travel. This direction of travel may be selected by an operator within cabin 16 and may be "forward" (e.g., to the right in FIGS. 1A and 1B). If machine 12 is autonomously or remotely operated, this direction may be received from a remote system, or generated with a control unit for facilitating autonomous control of machine 12, such as ECM 80 or an additional electronic control unit. During step 302, machine 12 may move in a forward direction or a reverse direction via ground-engaging traction devices 22.

During a step 304, which may be performed before and/or during step 302, one or both of doors 28 and 30 for rotor chamber 24 may be set in a desired position. In an example where front door 28 faces the direction of travel of machine 12, front door 28 may be in a fully-closed position or a nearly-closed position (e.g., less than 10% open). In other examples, doors 28 and/or 30 may be opened by a first amount (e.g., an amount set by an operator) that is greater than a 10% open position. An operator may set the position of doors 28 and/or 30 by interacting with one or more input devices within cabin 16, such as a switch, button, joystick, etc. In response to this request, the position of doors 28 and 30 may be set by controlling the supply of hydraulic fluid via hydraulic valves 70, 72, hydraulic lines 74, 76, etc. While the position set in step 304 may be selected by an operator, the position may instead be automatically generated by ECM 80. For example, ECM 80 may cause the door 28 or 30 facing the direction of travel to open by a first amount.

A step 306 may include receiving a rotor chamber door signal with ECM 80. This may further including detecting a state of an actuator that opens door 28 or door 30 with ECM 80. For example, ECM 80 may monitor a state of an actuator associated with the door 28 or 30 whose position was set in step 304, this door facing the direction of travel of machine 12. As described above, this may be performed by monitoring, via ECM 80, a pressure of hydraulic fluid associated with one or more hydraulic cylinders 32 and 36 with sensors 34 and 38 (sensors 134, 136, 138, and 140 in FIG. 2). Step 306 may include monitoring a position of a rod of one or more hydraulic cylinders 32 and 36, or a force placed on doors 28 and 30 (e.g., by placing one or more load cell sensors on doors 28 and 30), either in addition to or instead of monitoring hydraulic fluid pressure.

Step 308 may include determining when signals 202, 204, 206, and/or 208, that were received by ECM 80 during step 306 indicate that the door facing a direction of travel has encountered material. In an example where front door 28 is connected to a rod end of cylinder 32, and material strikes door 28, this material may tend to push door 28 inward toward rotor chamber 24. This motion can, in turn, tend to extend the rod of hydraulic cylinder 32 by pulling the rod of cylinder 32 away from the head end of cylinder 32. In some hydraulic systems, this may cause measureable movement of the rod of cylinder 32 and/or door 28. Other hydraulic systems may resist movement of the rod of cylinder 32 and door 28 such that no measureable movement occurs. Regardless of whether a measureable amount of motion occurs, the pressure detected with sensor 34 may tend to fluctuate. The amount of this pressure change may be compared to a predetermined threshold to determine when the pressure change (a pressure increase or decrease) indicates that the door facing the direction of motion has struck material.

A pressure of hydraulic fluid detected for the rod end of cylinder 32, e.g., with pressure sensor 134 (FIG. 2), will tend to increase as door 28 is pushed inwardly. Thus, a pressure change detected with sensor 134, such as a pressure increase, may be analyzed by automatic door monitoring module 82 to allow module 82 to determine that door 28 has encountered material. This pressure change may be compared to a predetermined threshold to determine when door 28 has encountered material. Additionally or alternatively, the value of pressure detected with sensor 134 may be compared to a predetermined threshold. For example, ECM 80 may determine, via automatic door monitoring module 82, that door 28 has encountered material when the detected pressure exceeds a first predetermined threshold (e.g., 250 bar) and, in response to this determination, issue a command for opening door 28, as described in further detail below with respect to step 310. This pressure may be monitored such that, when ECM 80 determines that the pressure has dropped below a second predetermined threshold that is lower than the first threshold (e.g., 200 bar) for at least a predetermined period of time, ECM 80 may issue a command to return door 28 to the previous position (e.g., a position set by the operator).

ECM 80 may determine that door 28 has encountered material when pressure sensed with sensor 134 exceeds a predetermined threshold for any period of time. In other configurations, ECM 80 may determine that door 28 has encountered material when a value of pressure detected with sensor 134 exceeds a predetermined threshold for at least a predetermined set period of time.

In a corresponding manner, a pressure drop detected for the head end of cylinder 32 with sensor 136 may indicate that door 30 has encountered material. In some configurations, the pressure increase measured by sensor 134 may be compared to a predetermined pressure threshold that, when exceeded (or exceeded for a set period of time), allows module 82 of ECM 80 to automatically issue a command for opening the associated door. A similar analysis may be performed for comparing a pressure drop measured with sensor 136.

ECM 80 may also perform the above-described analysis with sensors 138 and/or 140. For example, an analysis for rod end pressure sensor 140 may performed in the manner described above with respect to rod end sensor 134, and the analysis for head end pressure sensor 138 may be performed in the manner described above with respect to head end pressure sensor 136.

As noted above, while step 308 may include detecting hydraulic fluid pressure, if desired, step 308 may be performed with one or more position sensors that sense movement of hydraulic cylinders 32, 36, to determine when doors 28 and/or 30 are forced inwardly. For example, sensors 34 and/or 38 may be configured as one or more position sensors that output a signal that indicates when a cylinder associated with a door extends unexpectedly.

Based on the pressure(s) and/or position(s) detected with sensors 34 and 38, automatic door monitoring module 82 of ECM 80 may determine that a door facing the direction of travel of machine 12 has impacted or is plowing material. In response to this determination, in a step 310, module 82 may generate an output to increase the amount by which this door is opened. For example, module 82 of ECM 80 may generate front door command 212 or rear door command 214 that causes the hydraulic fluid system of automatic door control system 14 to actuate the appropriate hydraulic cylinder(s) to increase the amount by which door 28 or 30 is opened. In some aspects, step 310 may include opening door 28 or 30 by an additional predetermined amount (e.g., 25% farther with respect to the maximum range of motion of the door), opening door 28 or 30 to a predetermined minimum position (e.g., 50% open, 60% open, 70% open, etc.), opening door 28 or 30 by an amount based on the detected pressure (e.g., by opening door 28 or 30 by an amount that is determined as a function of the detected change in pressure), or opening door 28 or 30 to a fully-opened position. For example, step 310 may include opening door 28 or 30 by a first amount (e.g., a first amount in addition to the amount performed during step 304). By continuing to monitor doors 28 and 30, method 300 may include repeating step 310 so as to open the same door by a second amount in addition to the first amount. If desired, step 310 may further include presenting a notification to the operator, such as a visual or audio warning via display and/or audio devices present within cabin 16.

While method 300 may be performed to determine when a door facing direction of travel 201 has encountered (e.g., impacted) material, method 300 may also include performing closed-loop control over the door that faces away from the direction of travel 201. As described above, this closed-loop control may enable an operator to set a desired down-pressure for the door facing away from the direction of travel. Thus, the door (door 28 or 30) facing away from the direction of travel 201 may be controlled independently of the door that faces the direction of travel 201.

While steps 302, 304, 306, 308, and 310 have been described in an exemplary order, as understood, one or more of these steps may be performed and/or repeated in a different order. Moreover, any two or more of these steps may be performed simultaneously and/or at overlapping periods of time.

System 10 and method 300 may be useful for milling machines such as rotary mixers, cold planers, etc., to detect when a door has encountered material, or is continuing to encounter material, due to the motion of the machine. Thus, it may be possible to prevent plowing of material in worksites containing piles of loose material or other obstacles. Additionally, it may be possible to automatically open a door, by either opening a closed door or increasing the amount by which the door is open, preventing further wear and/or damage. By detecting or otherwise determining a direction of motion of the machine, it may also be possible to prevent damage to both front and rear doors, by monitoring the door that is currently acting as the "front" door that faces the direction of motion of the machine. The automatic monitoring and control over a "front" door may be performed in conjunction with automatic control over the opposite "rear" door, such as applying a predetermined pressure to facilitate accurate grading.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A method for monitoring a milling machine having a milling rotor and a rotor chamber surrounding the milling rotor, the method comprising:

propelling the milling machine in a direction of travel;

positioning a door of the rotor chamber at a first position with an actuator;

receiving a signal indicative of a condition of the actuator for positioning the door of the rotor chamber;

determining that the door has encountered material based on the signal; and opening the door of the chamber in response to determining that the door has encountered material.

2. The method of claim 1, wherein the actuator is a hydraulic cylinder.

3. The method of claim 2, wherein the signal is generated with a pressure sensor and the condition of the actuator is a pressure of hydraulic fluid associated with the hydraulic cylinder.

4. The method of claim 3, wherein the door is determined to have encountered material when the signal indicates that the pressure of the hydraulic fluid exceeds a predetermined threshold pressure.

5. The method of claim 2, wherein the signal is generated with a position sensor configured to detect a position of the hydraulic cylinder.

6. The method of claim 1, wherein the door is opened automatically in response to determining that the door has encountered material.

7. The method of claim 1, wherein the door of the rotor chamber faces the direction of travel.

8. The method of claim 7, further including automatically controlling an additional rotor chamber door that faces away from the direction of travel independently of the door that faces the direction of travel.

9. The method of claim 1, wherein the actuator is a hydraulic cylinder that includes a rod end and a head end and the received signal is indicative of a pressure of fluid supplied to the rod end of the hydraulic cylinder.

10. A method for monitoring a milling machine having a milling rotor, a rotor chamber surrounding the milling rotor, a first door of the rotor chamber, and a second door of the rotor chamber, the method comprising:

determining a direction of travel of the milling machine;

determining that the first door or the second door is a forward door that faces the direction of travel;

determining that the forward door has encountered material based on a signal generated with a sensor associated with the forward door; and automatically opening the forward door in response to determining that the door has encountered material.

11. The method of claim 10, wherein, when the direction of travel is reverse, the forward door is farther from a cabin of the milling machine as compared to the other door of the first door or the second door.

12. The method of claim 10, wherein the forward door is opened by a first amount before the forward door encounters material and is automatically opened by a second amount in response to determining that the forward door has encountered material.

13. The method of claim 10, wherein the signal is a pressure signal that indicates a pressure of hydraulic fluid for actuating a hydraulic cylinder.

14. The method of claim 10, wherein the signal is a position signal associated with a hydraulic cylinder of the milling machine.

15. A milling system, comprising:

a frame;

a rotor chamber connected to the frame, the rotor chamber having a first door and a second door opposite the first door;

a first hydraulic cylinder configured to open and close the first door;

a sensor configured to output a signal that indicates when the first door has encountered material; and a controller configured to:

receive the signal from the sensor, determine that the signal indicates that the first door has encountered material, determine a direction of travel of the milling machine, and determine that the first door faces the direction of travel, and cause the first door to open in response to determining that the first door has encountered material and that the first door faces the direction of travel.

16. The milling system of claim 15, further comprising a second hydraulic cylinder configured to open and close the second door, wherein the controller is configured to: open the second door in response to determining that the second door faces the direction of travel and has encountered material.

17. The milling system of claim 15, wherein the signal is a pressure signal of hydraulic fluid for actuating the first hydraulic cylinder.

18. The milling system of claim 17, wherein the controller is configured to cause the first door to open in response to determining that the hydraulic fluid has changed by an amount that is greater than a predetermined threshold amount.

19. The milling system of claim 15, wherein the signal is a position signal indicative of a position of a rod of the first hydraulic cylinder.

* * * * *